US007442670B2

(12) United States Patent
Odaka et al.

(10) Patent No.: US 7,442,670 B2
(45) Date of Patent: Oct. 28, 2008

(54) THERMAL TRANSFER SHEET

(75) Inventors: Tsuaki Odaka, Shinjuku-Ku (JP); Munenori Ieshige, Shinjuku-Ku (JP); Mitsuru Maeda, Shinjuku-Ku (JP); Masahiro Yuki, Shinjuku-Ku (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 330 days.

(21) Appl. No.: 10/584,474

(22) PCT Filed: Dec. 27, 2004

(86) PCT No.: PCT/JP2004/019571

§ 371 (c)(1),
(2), (4) Date: Jun. 23, 2006

(87) PCT Pub. No.: WO2005/063497

PCT Pub. Date: Jul. 14, 2005

(65) Prior Publication Data

US 2007/0196599 A1 Aug. 23, 2007

(30) Foreign Application Priority Data

Dec. 25, 2003 (JP) ..... 2003-430218
Dec. 26, 2003 (JP) ..... 2003-433436

(51) Int. Cl.
*B41M 5/42* (2006.01)

(52) U.S. Cl. ..... 503/227; 428/32.81

(58) Field of Classification Search ..... None
See application file for complete search history.

(56) References Cited

U.S. PATENT DOCUMENTS 5,147,843 A 9/1992 Bodem et al.
2003/0181331 A1 9/2003 Ieshige et al.

FOREIGN PATENT DOCUMENTS

JP 03-104683 A1 5/1991
JP 05-131760 A1 5/1993
JP 08-290678 A1 11/1996
JP 2003-312151 A1 11/2003
JP 2004-074766 A1 3/2004

*Primary Examiner*—Bruce H Hess
(74) *Attorney, Agent, or Firm*—Burr & Brown

(57) ABSTRACT

A thermal transfer sheet that can meet demands for increased printing speed in thermal transfer, increased density of thermally transferred images, and higher quality and, at the same time, particularly can suppress fusing to image receiving sheets and abnormal transfer. The thermal transfer sheet includes a base material, a heat resistant slip layer provided on one side of the base material, and an adhesive layer and a dye layer provided in that order on the other side of the base material, wherein the adhesive layer includes a specific polyvinylpyrrolidone resin.

7 Claims, 1 Drawing Sheet

THERMAL TRANSFER SHEET

TECHNICAL FIELD

The present invention relates to a thermal transfer sheet comprising a base material, a heat resistant slip layer, an adhesive layer, and a dye layer.

BACKGROUND ART

Various thermal transfer recording methods have hitherto been known in the art. Among others, a method for forming various full-color images using dyes for dye sublimation transfer as recording materials has been proposed. In this method, a thermal transfer sheet comprising dye layers formed by holding, by a suitable binder, dyes as recording materials on a base material such as a polyester film is provided, and the sublimable dyes are thermally transferred from the thermal transfer sheet onto a thermal transfer image-receiving sheet comprising a dye-receptive layer provided on an object dyeable with a sublimable dye, for example, paper or plastic film to form a full-color image. In this case, a large number of color dots of three or four colors with the quantity of heat being regulated are transferred by heating by means of a thermal head as heating means in a printer onto a receptive layer in the thermal transfer image-receiving sheet to reproduce a full color of an original by the multicolor dots. In this method, since coloring materials used are dyes, the formed images are very sharp and are highly transparent and thus are excellent in reproduction of intermediate colors and in gradation and are comparable with images formed by conventional offset printing or gravure printing. At the same time, this method can form high-quality images comparable with full-color images formed by photography.

In the thermal transfer recording method utilizing the thermal dye sublimation transfer, it has been pointed out that an increase in printing speed of thermal transfer printers has posed a problem that conventional thermal transfer sheets cannot provide satisfactory print density. Further, high density and high sharpness have become required of prints of images formed by thermal transfer. To meet this demand, various attempts have been made to improve thermal transfer sheets and thermal transfer image-receiving sheets which receive sublimable dyes transferred from the thermal transfer sheets to form images. For example, an attempt to improve the sensitivity in transfer at the time of printing has been made by reducing the thickness of the thermal transfer sheet. However, it has been pointed out that cockling occurs due to heat, pressure or the like applied at the time of the production of the thermal transfer sheet or at the time of thermal transfer recording and, in a few cases, breaking of the thermal transfer sheet occurs.

Further, an attempt to improve the print density and the sensitivity in transfer at the time of printing has been made by increasing the dye/binder ratio in the dye layer of the thermal transfer sheet. In this case, however, during storage in a wound state, the dye is transferred onto the heat-resistant slip layer provided on the backside of the thermal transfer sheet, and, at the time of rewinding, the dyes transferred onto the heat-resistant slip layer is retransferred onto dye layers of other colors or the like. That is, a kick back phenomenon occurs. When the contaminated dye layers are thermally transferred onto an image-receiving sheet, hue different from a designated one is provided, or otherwise the so-called "smudge" occurs. Further, in the image formation by thermal transfer, when high energy is applied in a thermal transfer printer, fusing of the dye layer to the receptive layer, that is, the so-called "abnormal transfer," is likely to occur. A large amount of a release agent can be added to the receptive layer for abnormal transfer prevention purposes. However, it has been found that the addition of a large amount of the release agent causes blurring, smudge and other unfavorable phenomena of the image.

On the other hand, patent document 1 "Japanese Examined Patent Publication (Kokoku) No. 102746/1995" proposes a thermal transfer sheet wherein a hydrophilic barrier/subbing layer comprising polyvinylpyrrolidone as a main component and, mixed with the main component, polyvinyl alcohol as a component for enhancing dye transfer efficiency is provided between a dye layer and a support. When polyvinyl alcohol is used, the adhesion between the dye layer and the base material is unsatisfactory. Further, when polyvinylpyrrolidone and polyvinyl alcohol are used in such an addition amount as disclosed in Japanese Examined Patent Publication (Kokoku) No. 102746/1995, the adhesion is sometimes poor.

Japanese Patent Application No. 181812/2002 proposes a thermal transfer sheet that can realize an enhancement in sensitivity in the thermal transfer and can suppress abnormal transfer by using a polyvinylpyrrolidone-containing primer layer for a dye layer. As a result of a confirmative examination by the present inventors, however, it was found that, in this thermal transfer sheet, due to hygroscopicity by polyvinylpyrrolidone, particularly under high temperature and high humidity conditions, the adhesion of the primer layer is deteriorated and, at the time of thermal transfer, the dye layer is transferred in a layer form onto the image receptive layer in the image receiving sheet, or otherwise the separation and transfer, in a layer form, of the receptive layer onto the dye layer side, which are considered as derived from mixing of the primer layer with the dye layer, disadvantageously take place.

On the other hand, the present inventors have developed a thermal transfer sheet comprising an adhesive layer formed of a polyvinylpyrrolidone resin provided between the dye layer and the support and have filed a patent application (Japanese Patent Application No. 176982/2002). This thermal transfer sheet is advantageous in that the adhesive layer can enhance the efficiency of dye transfer onto the image receiving sheet to improve the print density and, at the time of printing, fusing to the image receiving sheet and abnormal transfer can also be suppressed. However, printing under a severe environment such as high humidity and use of an image receiving sheet having low releasability after long-term storage of this thermal transfer sheet comprising this adhesive layer under a high humidity environment such as an environment of 40° C. and 90% have sometimes caused fusing between the thermal transfer sheet and the image receiving sheet and abnormal transfer.

Accordingly, even when the thermal transfer printer and thermal transfer recording materials for the thermal transfer sheet and the thermal transfer image receiving sheet are regulated for meeting requirements for increased printing speed of the thermal transfer, increased density of thermally transferred images and higher quality, unfavorable phenomena take place including that no satisfactory print density can be provided and abnormal transfer occurs at the time of thermal transfer, making it impossible to provide printed matter having satisfactory quality.

Accordingly, at the present invention, the development of a thermal transfer sheet, which can meet requirements for increased printing speed of the thermal transfer, increased density of thermally transferred images and higher quality, and, at the same time, can produce printed matter having satisfactory quality, has been desired.

RELATED APPLICATIONS

The present application is an application related to Japanese Patent Application No. 430218/2003 (JP), Japanese Patent Application No. 433436/2003 (JP), and International Patent Application PCT/US2001/022722. Accordingly, the contents disclosed in the specification originally attached to these patent applications are incorporated herein by reference.

SUMMARY OF THE INVENTION

First Embodiment of the Present Invention

At the time of the present invention, the present inventors have found that a thermal transfer sheet comprising an adhesive layer containing a three-dimensionally crosslinked polyvinylpyrrolidone resin can satisfactorily meet requirements for increased printing speed in thermal transfer, increased density of thermally transferred images, higher quality and the like, can improve the sensitivity in transfer at the time of printing, and, even under a severe printing environment such as under a high temperature and high humidity environment, can effectively prevent the occurrence of abnormal transfer and cockling or the like. The present invention has been made based on such finding.

Accordingly, the present invention is to provide a thermal transfer sheet that can meet requirements for increased printing speed in thermal transfer, increased density of thermally transferred images, and higher quality, and, at the same time, can produce high-quality printed matter.

Thus, according to the first aspect of the present invention, there is provided a thermal transfer sheet comprising: a base material; a heat resistant slip layer; an adhesive layer; and a dye layer, wherein said heat resistant slip layer is provided on one side of said base material, said adhesive layer and said dye layer are provided in that order on the other side of said base material, and said adhesive layer comprises a three-dimensionally crosslinked product of a polyvinylpyrrolidone resin.

According to the thermal transfer sheet of the present invention, the adhesive layer comprises a three-dimensionally crosslinked polyvinylpyrrolidone resin. By virtue of this construction, the adhesion between the dye layer and the base material can be enhanced even in a high-temperature and high-humidity environment, and abnormal transfer and the like can be prevented. Further, in the thermal transfer, the sensitivity in transfer can be significantly improved, and high-density thermally transferred images can advantageously be provided without the need to apply a high level of energy.

Second Aspect of the Present Invention

At the time of the present invention, the present inventors have found that, according to a thermal transfer sheet comprising an adhesive layer containing a polyvinylpyrrolidone resin, and one material or a mixture of two or more materials selected from silanol group-containing resins, silanol group-containing oligomers, and silane coupling agents, requirements for increased printing speed in thermal transfer, increased density of thermally transferred images, and higher quality can be satisfactorily met, and fusing to the image receiving sheet and abnormal transfer can be effectively prevented. The present invention has been made based on such finding.

Accordingly, the present invention is to provide a thermal transfer sheet that can meet requirements for increased printing speed in thermal transfer, increased density of thermally transferred images, and higher quality, and, at the same time, can produce high-quality printed matter.

According to the second aspect of the present invention, there is provided a thermal transfer sheet comprising: a base material; a heat resistant slip layer; an adhesive layer; and a dye layer, wherein said heat resistant slip layer is provided on one side of said base material, said adhesive layer and said dye layer are provided in that order on the other side of said base material, and said adhesive layer comprises a polyvinylpyrrolidone resin, and one material or a mixture of two or more materials selected from silanol group-containing resins, silanol group-containing oligomers, and silane coupling agents.

In the thermal transfer sheet according to the present invention, since the adhesive layer contains a polyvinylpyrrolidone resin, the efficiency of transfer of dye onto the image receiving sheet can be enhanced to improve the print density. Further, since the adhesive layer comprises one material or a mixture of two or more materials selected from silanol group-containing resins, silanol group-containing oligomers, and silane coupling agents, even in printing under a high-humidity environment, the adhesion is high, and fusing and abnormal transfer can be effectively suppressed.

BEST MODE FOR CARRYING OUT THE INVENTION

First Aspect of the Present Invention

Figure 1:
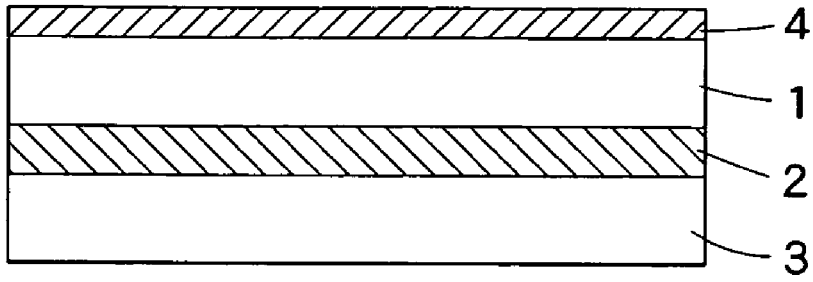
FIG. 1 is a schematic cross-sectional view showing one embodiment of the thermal transfer sheet in the present invention.

The thermal transfer sheet according to the first aspect of the present invention will be described with reference to FIG. 1. FIG. 1 is a schematic diagram showing one embodiment of the thermal transfer sheet in the first aspect of the present invention. In the thermal transfer sheet shown in FIG. 1, a heat resistant slip layer 4, which functions to improve the slipperiness of a thermal head and to prevent sticking, is provided on one side of the base material 1. An adhesive layer 2 comprising a mixture containing a three-dimensionally crosslinked polyvinylpyrrolidone resin and a dye layer 3 are provided in that order on the other side of the base material 1.

1. Base Material

The base material may be any material so far as it has a certain level of heat resistance and strength. For example, polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellophane, cellulose derivatives such as cellulose acetate, polyethylene films, polyvinyl chloride films, nylon films, polyimide films, and ionomer films may be mentioned as specific examples of such base materials. The thickness of the base material is about 0.5 to 50 μm, preferably about 1 to 10 μm.

In the present invention, in forming an adhesive layer on the base material according to the present invention, when the adhesive layer has satisfactory adhesion to the base material, the adhesive layer can be provided directly on the base material without adhesion treatment of the base material. For example, an adhesive component can be added to the adhesive layer to enhance the adhesion to the base material.

In the present invention, however, adhesion treatment can be carried out on the base material in its surface where the adhesive layer and the dye layer are formed. When the base material is formed of a plastic film, this adhesion treatment is particularly preferred because, when an adhesive layer is formed by coating on the base material, the wetting properties, adhesion and the like of the coating liquid can be improved. Conventional resin surface modification techniques such as corona discharge treatment, flame treatment, ozone treatment, ultraviolet treatment, radiation treatment, roughening treatment, chemical agent treatment, plasma treatment, low-temperature plasma treatment, primer treatment, and grafting treatment may be applied as the adhesion treatment. A combination of two or more of these treatment methods may also be used. The primer treatment may be carried out, for example, by coating, in melt extrusion of a plastic film to form a film, a primer liquid onto an unstretched film and then subjecting the assembly to stretching treatment.

Primer Layer

The adhesion treatment can be carried out by coating a primer layer between the base material and the adhesive layer. The primer layer may be formed of a resin, and examples of such resins include polyester resins, polyacrylic ester resins, polyvinyl acetate resins, polyurethane resins, styrene acrylate resins, polyacrylamide resins, polyamide resins, polyether resins, polystyrene resins, polyethylene resins, polypropylene resins, vinyl resins such as polyvinyl chloride resins and polyvinyl alcohol resins, and polyvinyl acetoacetal resins such as polyvinylacetoacetal and polyvinylbutyral.

2. Adhesive Layer

The adhesive layer comprises a three-dimensionally crosslinked polyvinylpyrrolidone resin. When the three-dimensionally crosslinked polyvinylpyrrolidone resin has a high molecular weight (weight average molecular weight: about 800000 to 3500000), the use of a polyvinylpyrrolidone resin in which only a part in one molecule of the polyvinylpyrrolidone resin has been crosslinked is preferred rather than a polyvinylpyrrolidone in which 100% in one molecule has been crosslinked. As compared with the polyvinylpyrrolidone resin in which 100% in one molecule has been crosslinked, the partially crosslinked polyvinylpyrrolidone has better solubility in water, alcohols, and organic solvents and can solve various problems involved in the preparation of the liquid composition and coating, and, consequently, a homogeneous adhesive layer can be formed. Accordingly, in the present invention, when the three-dimensionally crosslinked polyvinylpyrrolidone resin has a high molecular weight, preferably, about 10% to about 70% of one molecule has been crosslinked. In the present invention, when the three-dimensionally crosslinked polyvinylpyrrolidone has a relatively low molecular weight (weight average molecular weight: about 100000 to 800000), even in the case where the whole part (100%) of one molecule has been three-dimensionally crosslinked, such three-dimensionally crosslinked polyvinylpyrrolidones may be used as a mixture with a partially three-dimensionally crosslinked polyvinylpyrrolidone resin so far as the wholly three-dimensionally crosslinked polyvinylpyrrolidone having a relatively low molecular weight has good solubility in water, alcohols, and organic solvents.

Accordingly, the adhesive layer may be formed of a three-dimensionally crosslinked polyvinylpyrrolidone resin only, preferably a partially three-dimensionally crosslinked polyvinylpyrrolidone resin only. Alternatively, the adhesive layer may be formed of a mixture comprised of a (preferably partially) three-dimensionally crosslinked polyvinylpyrrolidone resin, a linear polyvinylpyrrolidone resin and/or a low-molecular weight three-dimensionally crosslinked polyvinylpyrrolidone resin of which the whole part has been three-dimensionally crosslinked, and a linear polyvinylpyrrolidone resin. The addition of a linear polyvinylpyrrolidone resin is preferred from the viewpoint of improving the sensitivity in transfer at the time of printing.

In a preferred embodiment of the present invention, the content of a crosslinked polyvinylpyrrolidone resin (partially crosslinked polyvinylpyrrolidone resin) is preferably 10% to 30% based on the total solid content of the adhesive layer. In a more preferred embodiment of the present invention, the proportion of the "three dimensional crosslinking" in the three-dimensionally crosslinked polyvinylpyrrolidone resin is 5% to 50%, preferably 10% to 30%. The addition amount of the three-dimensionally crosslinked polyvinylpyrrolidone resin is 5% by weight to 50% by weight, preferably 10% by weight to 30% by weight, based on the total solid content of the components of the adhesive layer.

The addition of the three-dimensionally crosslinked polyvinylpyrrolidone in this proportion can improve the adhesion between the dye layer and the base material particularly under high temperature and high humidity conditions, over the adhesive layer formed of a linear polyvinylpyrrolidone resin only. When a linear polyvinylpyrrolidone resin is mixed in the three-dimensionally crosslinked polyvinylpyrrolidone, high hygroscopicity of this resin can be satisfactorily compensated. As a result, the adhesion between the dye layer and the base material under high temperature and high humidity conditions can be improved, and, at the same time, abnormal transfer and the like can be effectively prevented. Further, in preparing a liquid composition for an adhesive layer, the solubility in water, alcohols and organic solvents can be improved, and, consequently, a homogeneous adhesive layer can be formed.

Polyvinylpyrrolidone resins used as high-molecular weight (low-molecular weight) three-dimensionally crosslinked polyvinylpyrrolidone resins or linear polyvinylpyrrolidone resins include, for example, homopolymers and copolymers of vinylpyrrolidones such as N-vinyl-2-pyrrolidone and N-vinyl-4-pyrrolidone. Preferably, the polyvinylpyrrolidone resin has a K value in a Fickencher's formula of not less than 60. In particular, K-60 to K-120 grades may be used, and the number average molecular weight is about 30,000 to 280,000. When the K value of the polyvinylpyrrolidone resin is less than 60, the effect of improving the sensitivity in transfer at the time of printing is disadvantageously lowered.

A copolymer of vinylpyrrolidone with other copolymerizable monomer may also be used as the polyvinylpyrrolidone resin. Copolymerizable monomers other than the vinylpyrrolidone include, for example, vinyl monomers such as styrene, vinyl acetate, acrylic esters, acrylonitrile, maleic anhydride, vinyl chloride (fluoride), and vinylidene chloride (fluoride or cyanide). Copolymers produced by radical copolymerization of the vinyl monomer with the vinylpyrrolidone may be used.

Three-Dimensional Crosslinking

In the present invention, the three-dimensionally crosslinked polyvinylpyrrolidone resin can be produced by three-dimensionally crosslinking particularly a linear polyvinylpyrrolidone resin, for example, with a carboxyl group-containing compound through a hydrogen bond, an ion bond or the like.

Examples of compounds used in three-dimensional crosslinking include carboxyl group-containing compounds. For example, poly(meth)acrylic acid and/or (meth)acrylic acid copolymers may be mentioned as a polymer produced by polymerizing one or at least two monomers containing a carboxyl group and an ethylenically unsaturated group. In the present invention, the compound used in the three-dimensional crosslinking is not limited to carboxyl group-containing compounds and may be compounds containing a functional group other than the carboxyl group.

Three-dimensionally crosslinked polyvinylpyrrolidone resins may be commercially available products. For example, ViviPrint540@polymerolymer (manufactured by ISP INVESTMENTS INC) is preferred. ViviPrint540@polymerolymer is known as a solvent which is preferably used in ink jet coating media. The three-dimensionally crosslinked polyvinylpyrrolidone resin may be produced by the process disclosed in International Patent Application PCT/US2001/022722, the disclosure of which is incorporated herein by reference. Specifically, the three-dimensionally crosslinked polyvinylpyrrolidone resin may be produced by the following process.

Synthesis 1. 131.81 g of VP, 756 g of Dl water, and 0.197 g of PETE (0.15% based on the monomer) were added to a 2-L kettle equipped with a nitrogen inlet tube, a thermocouple, a stirrer, and a feed line.

2. The subsurface was purged with nitrogen for 30 min.

3. The contents of the kettle were heated to 70° C.

4. An initiator was added at the time of 0 min and 30 min. 0.48 g of Vazo (registered trademark) 67 in 1.5 g of IPA was added for each shot, and washing with 1.0 g of IPA was carried out twice.

5. The reaction temperature was kept at 70° C. for a whole day and night.

6. When the amount of the residual VP is less than 400 ppm, this batch was diluted with 320.04 g of Dl water.

7. The batch was cooled to 50° C.

8. 0.15 to 0.19% of BTC50NF was added as a preservative.

9. The product was a two-phase polymerization composition containing 40 to 70% of resin particles, and the soluble fraction had a molecular weight of 1,200,000 to 1,500,000.

Property 1

95.2 g of a solid polyvinylpyrrolidone/PETE having a solid content of about 10% was diluted in a 2-L distilled water, and the mixture was stirred for through mixing. A second solution was prepared by measuring 500 mL of the first solution, diluting the first solution in 2 L of distilled water, and stirring the mixture for through mixing. The second solution was poured into four 16-ounce (about 454 g) jars and was centrifuged at about 2250 rpm for about 90 min. White precipitate was observed on the bottom of each 16-ounce jar. The precipitate was removed by a pipette and was placed in four 8-drum (about 14 g) vials. The four 8-drum vials were centrifuged at about 3000 rpm for 60 min. The particle diameter of the precipitate was measured with Microtrak UPA and was found to be about 4 nm.

Property 2

A 1% aqueous polymer solution of PVA/PETE (Example 4) was thoroughly mixed with a 1% aqueous polymer solution of Kelcoloid HVF Algin (HVF). The Brookfield viscosity of each solution and a combination of the solutions was measured, and the effect of hydrodynamic modification was exemplified. As a result of visual observation, the solution was seemed to be homogeneous. The results are shown in Table 1 below.

TABLE 1

| Test solution | Brookfield | Viscosity, cps | Percent scale |
|---|---|---|---|
| 1% PVP/PETE, in water | LV, 00, 12 RPM | 12.4 | 24.8 |
| 1% HVF, in water | LV, 62, 30 RPM | 709 | 71.4 |
| 50/50 (w/w) mixture | LV, 61, 12 RPM | 129.5 | 26.1 |

Formation of Adhesive Layer

The adhesive layer may be formed by providing a three-dimensionally crosslinked polyvinylpyrrolidone resin per se or a mixture of the three-dimensionally crosslinked polyvinylpyrrolidone resin with a linear polyvinylpyrrolidone resin, optionally adding an additive thereto, dissolving and/or dispersing the material in water or aqueous solvents such as alcohols, or organic solvents to prepare a liquid composition, and coating the liquid composition by conventional coating means such as gravure printing, screen printing, or reverse roll coating using a gravure plate. The coverage amount of the adhesive layer is about 0.01 to 0.3 g/m$^2$, preferably 0.05 to 0.15 g/m$^2$, on a dry basis. When the coverage is in the above-defined range, the concaves on the base material can be filled with the coating to form an even surface, that is, no uncoated part occurs. As a result, an abnormal transfer phenomenon that, in the thermal transfer, the dye layer is disadvantageously transferred onto the image receptive layer side of the image receiving sheet, can be effectively prevented. Further, mixing of the adhesive layer with the dye layer at the time of coating of the dye layer can be prevented, and, thus, in the thermal transfer, abnormal transfer of the receptive layer onto the dye layer side can be effectively prevented.

3. Dye Layer

The dye layer may be formed as a single layer of one color, or alternatively may be formed as a plurality of layers containing dyes with different hues. The dye layer may be formed repeatedly in a face serial manner on an identical plane of the identical base material. The dye layer is a layer comprising a thermally transferable dye supported by any desired binder. Dyes, which are thermally melted, diffused or transferred by sublimation, are usable in the dye layer, and any dye used in conventional dye sublimation thermal transfer sheets may be used. The dye may be properly selected by taking into consideration, for example, hue, sensitivity in printing, lightfastness, storage stability, and solubility in binders.

Specific examples of dyes include: diarylmethane dyes; triarylmethane dyes; thiazole dyes; methine dyes such as merocyanine dyes and pyrazolone methine dyes; azomethine dyes typified by indoaniline dyes, acetophenoneazomethine dyes, pyrazoloazomethine dyes, imidazoleazomethine dyes, imidazoazomethine dyes, and pyridoneazomethine dyes; xanthene dyes; oxazine dyes; cyanomethylene dyes typified by dicyanostyrene dyes and tricyanostyrene dyes; thiazine dyes; azine dyes; acridine dyes; azo dyes such as benzeneazo dyes, pyridoneazo dyes, thiopheneazo dyes, isothiazoleazo dyes, pyrroleazo dyes, pyrraleazo dyes, imidazoleazo dyes, thiadiazoleazo dyes, triazoleazo dyes, and disazo dyes; spiropyran dyes; indolinospiropyran dyes; fluoran dyes; rhodaminelactam dyes; naphthoquinone dyes; anthraquinone dyes; and quinophthalone dyes.

In forming the dye layer, a binder may be added to a composition (a liquid composition) for dye layer formation, and, for example, a conventional resin binder may be used. Specific examples of preferred binders (resins) include: cellulosic resins such as ethylcellulose, hydroxyethylcellulose, ethylhydroxycellulose, hydroxypropylcellulose, methylcellulose, cellulose acetate, and cellulose butyrate; vinyl resins such as polyvinyl alcohol, polyvinyl acetate, polyvinyl butyral, polyvinyl acetal, polyvinylpyrrolidone, and polyacrylamide; polyester resins; and phenoxy resins. Among them, cellulosic resins, acetal resins, butyral resins, polyester resins, phenoxy resins and the like are particularly preferred, for example, from the viewpoints of heat resistance and transferability of dye.

Further, in the present invention, instead of the resin binder, the following releasable graft copolymers may be used as a release agent or a binder. The releasable graft copolymers are such that at least one releasable segment selected from a polysiloxane segment, a carbon fluoride segment, a hydrocarbon fluoride segment, and a long-chain alkyl segment has been graft polymerized to the main chain of a polymer. Among them, a graft copolymer produced by grafting a polysiloxane segment onto the main chain of a polyvinyl acetal resin is particularly preferred.

The dye layer may comprise the above dye, the binder, and optionally other various additives commonly used in the prior art. For example, organic fine particles, such as polyethylene wax, and inorganic fine particles may be mentioned as additives for improving the separability of the thermal transfer sheet from the image-receiving sheet and the coatability of the ink.

In general, the dye layer may be formed by adding the dye, the binder, and optional additives to a suitable solvent to dissolve or disperse the ingredients and thus prepare a liquid composition, coating the liquid composition onto a base material, and drying the coating. Conventional coating means, such as gravure printing, screen printing, and reverse roll coating using a gravure plate, may be used for the coating. The coverage of the dye layer is 0.2 to 6.0 g/m$^2$, preferably about 0.3 to 3.0 g/m$^2$, on a dry basis.

4. Heat-Resistant Slip Layer

In the thermal transfer sheet according to the present invention, a heat resistant slip layer is provided mainly from the viewpoint of preventing adverse effects such as sticking caused by heat of a thermal head and cockling at the time of printing.

The heat resistant slip layer may be formed using a resin. In this case, any conventional resin may be used, and examples thereof include polyvinyl butyral resins, polyvinyl acetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, prepolymers of urethane or epoxy, nitrocellulose resins, cellulose nitrate resins, cellulose acetopropionate resins, cellulose acetate butyrate resins, cellulose acetate hydrodiene phthalate resins, cellulose acetate resins, aromatic polyamide resins, polyimide resins, polyamide-imide resins, polycarbonate resins, and chlorinated polyolefin resins.

The heat resistant slip layer may also be formed by adding a slipperiness-imparting agent to the resin, or by top-coating a slipperiness-imparting agent to the heat resistant slip layer formed of a resin. Specific examples of slipperiness-imparting agents include phosphoric esters, silicone oils, graphite powder, silicone graft polymers, fluoro graft polymers, acrylsilicone graft polymers, acrylsiloxanes, arylsiloxanes, and other silicone polymers. A preferred slipperiness-imparting agent comprises a polyol, for example, a high-molecular polyalcohol compound, a polyisocyanate compound and a phosphoric ester compound. In the present invention, the addition of a filler is more preferred.

The heat-resistant slip layer may be formed by dissolving or dispersing the resin, the slipperiness-imparting agent, and a filler in a suitable solvent to prepare a liquid composition for a heat resistant slip layer, coating the liquid composition onto the base material sheet by forming means, such as gravure printing, screen printing, or reverse roll coating using a gravure plate, and drying the coating. The coverage of the heat-resistant slip layer is preferably 0.1 to 3.0 g/m$^2$ on a solid basis.

Second Aspect of the Present Invention

The second aspect of the present invention will be described with reference to FIG. 1. FIG. 1 is a schematic cross-sectional view showing one embodiment of a thermal transfer sheet according to the second aspect of the present invention as well as the first aspect of the present invention. In the thermal transfer sheet according to the present invention shown in FIG. 1, a heat resistant slip layer 4, which functions to improve the slipperiness of a thermal head and to prevent sticking, is provided on one side of a base material 1. An adhesive layer 2 and a dye layer 3 are provided in that order on the other side of the base material 1.

Figure 2:
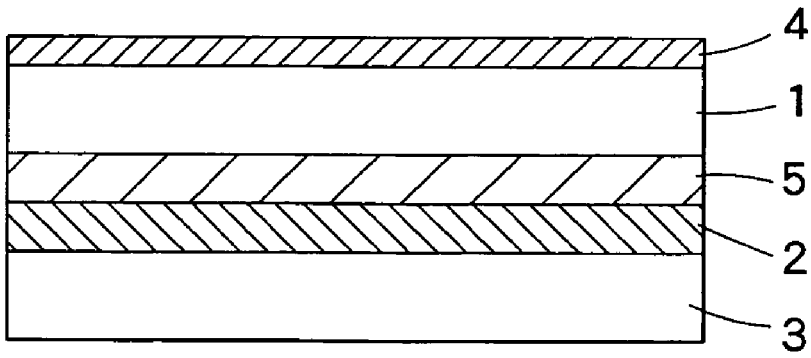
FIG. 2 is a schematic cross-sectional view showing another embodiment of the thermal transfer sheet in the present invention.

Another embodiment of the thermal transfer sheet according to the second aspect of the present invention will be described with reference to FIG. 2. Specifically, FIG. 2 is a schematic cross-sectional view showing another embodiment of the thermal transfer sheet according to the second aspect of the present invention. In the thermal transfer sheet shown in FIG. 2, a heat resistant slip layer 4, which functions to improve the slipperiness of a thermal head and to prevent sticking, is provided on one side of a base material 1. A primer layer 5, an adhesive layer 2, and a dye layer 3 are provided in that order on the other side of the base material 1.

The thermal transfer sheet according to the second aspect of the present invention is different from the thermal transfer sheet according to the first aspect of the present invention only in an adhesive layer which will be described later, and the other construction in the thermal transfer sheet according to the present invention, for example, the base material, the primer layer, the heat resistant slip layer, and the dye layer may be the same as in the thermal transfer sheet according to the first aspect of the present invention.

Adhesive Layer

In the present invention, the adhesive layer comprises a polyvinylpyrrolidone resin, and one material or a mixture of two or more materials selected from silanol group-containing resins, silanol group-containing oligomers, and silane coupling agents.

Specific examples of polyvinylpyrrolidone resins include homopolymers and copolymers of vinylpyrrolidones such as N-vinyl-2-pyrrolidone and N-vinyl-4-pyrrolidone.

In a preferred embodiment of the present invention, the adhesive layer further comprises a modification product of a polyvinylpyrrolidone resin. An example of the modification product of polyvinylpyrrolidone is a copolymer of vinylpyrrolidone with another copolymerizable monomer. Copolymerizable monomers include, for example, vinyl monomers such as styrene, vinyl acetate, acrylic esters, acrylonitrile, maleic anhydride, vinyl chloride (fluoride), and vinylidene chloride (fluoride or cyanide). Copolymers produced by radical copolymerization of the vinyl monomer with vinylpyrrolidone may be used. Other copolymers usable herein include block copolymers or graft copolymers of polyester resins, polycarbonate resins, polyurethane resins, epoxy resins, acetal resins, butyral resins, formal resins, phenoxy resins, cellulosic resins or the like with polyvinylpyrrolidone. Examples of another modification products include materials obtained by crosslinking a part of polyvinylpyrrolidone to change properties of polyvinylpyrrolidone. In a preferred embodiment of the present invention, three-dimensionally crosslinked (wholly or partially) polyvinylpyrrolidone resins as described in connection with the first aspect of the present invention are used. For example, ViviPrint540polymer (manufactured by ISP INVESTMENTS INC.) as a commercially available product is preferred. Accordingly, the three-dimensionally crosslinked (wholly or partially) polyvinylpyrrolidone resins described in the first embodiment of the present invention are also applied to the second embodiment of the present invention.

Any conventional one material or a mixture of two or more materials selected from silanol group-containing resins, silanol group-containing oligomers, and silane coupling agents (hereinafter referred to as "silane or silanol material") may be used as an adhesive component. These materials can also improve the heat resistance of the adhesive layer, and abnormal transfer at the time of printing at high energy can be suppressed. Amino group, epoxy group, and methacryl group-containing types are particularly preferred for improving the adhesion. The content of the silane or silanol material is 1 to 30% by weight, preferably 1 to 20% by weight, based on the whole solid content of the adhesive layer. When the addition amount is in the above-defined range, effects as the adhesive component and heat resistance improving component, as well as print density improvement effects by polyvinylpyrrolidone resins, can be satisfactorily attained.

In the adhesive layer, in addition to the above component, an adhesive component can be further mixed to improve the adhesion between the base material and the dye layer. Specific examples of such adhesive components include polyester resins, vinyl resins such as polyacrylic ester resins, polyvinyl acetate resins, polyurethane resins, styrene acrylate resins, polyacrylamide resins, polyamide resins, polyether resins, polystyrene resins, polyethylene resins, polypropylene resins, polyvinyl chloride resins and vinyl-chloride-vinyl acetate copolymer resins, and ethylene-vinyl acetate copolymer resins, and polyvinylacetal resins such as polyvinylacetoacetal and polyvinylbutyral. Polyester resins, polyurethane resins, and acrylic resins are particularly preferred as the adhesive component because of high adhesive properties. The addition amount of the adhesive component is preferably 1 to 20% by weight based on the solid content of the whole adhesive layer. When the addition amount is in the above-defined range, satisfactory adhesive can be exhibited. Further, the effect of improving the print density by the polyvinylpyrrolidone resin can be satisfactorily attained.

In the adhesive layer, additives, for example, wettability improvers, fluorescent brighteners or various fillers may be added to the composition for adhesive layer formation.

Adhesive Layer Formation

The adhesive layer may be formed by dissolving and/or dispersing an adhesive layer forming component in an organic solvent or a water-based solvent to prepare a liquid composition and coating the liquid composition by conventional coating means such as gravure printing, screen printing, or reverse roll coating using a gravure plate. The adhesive layer may be formed by full density blotted coating on the base material in its whole area of the dye layer coating side, or alternatively the adhesive layer may be coated in a pattern only between the base material and the dye layer. When the organic solvent is used in the liquid composition, polyvinylpyrrolidone resins, modification products of polyvinylpyrrolidone resins, silanes, silanol materials or the like used as the adhesive component are such a type that can easily be dissolved or dispersed in the solvent. When the aqueous solvent is used in the liquid composition, polyvinylpyrrolidone resins, modification products of polyvinylpyrrolidone resins, silanes, silanol materials or the like used as the adhesive component are water-soluble or aqueous emulsion type resins.

The coverage of the adhesive layer thus formed is preferably 0.01 to 3.0 g/m$^2$ on a dry basis.

EXAMPLES

The contents of the present invention could easily be understood by the following Examples. However, it should be noted that the present invention is not limited to these Examples. In the following Examples, "parts" or "%" is by mass unless otherwise specified.

First Aspect of the Present Invention

Preparation of Thermal Transfer Sheet

Example X1

A 4.5 μm-thick untreated polyethylene terephthalate (PET) film (DIAFOIL K 880, manufactured by Mitsubishi Polyester Film Co., Ltd.) was provided as a base material. A liquid composition A having the following composition for an adhesive layer was gravure coated onto the PET film at a coverage of 0.06 g/m$^2$ on a dry basis, and the coating was dried at 110° C. for one min to form an adhesive layer. A liquid composition 1 having the following composition for a dye layer was then gravure coated on the adhesive layer at a coverage of 0.8 g/m$^2$ on a dry basis, and the coating was dried to form a dye layer. Thus, a thermal transfer sheet of Example X1 was prepared. In this case, a liquid composition having the following composition for a heat resistant slip layer was previously gravure coated on the other side of the base material at a coverage of 1.0 g/m$^2$ on a dry basis, and the coating was dried to form a heat resistant slip layer.

| <Liquid composition A for adhesive layer> | |
|---|---|
| Polyvinylpyrrolidone resin (K-90, manufactured by ISP K.K.) | 9 parts |
| Three-dimensionally crosslinked product of polyvinylpyrrolidone resin having degree of crosslinking of about 40% (Vivi Print 540 polymer, manufactured by ISP K.K.) | 1 part |
| Methyl ethyl ketone | 83 parts |
| Isopropyl alcohol | 83 parts |

| <Liquid composition 1 for dye layer> | |
|---|---|
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |

| <Liquid composition for heat resistant slip layer> | |
|---|---|
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example X2

The same base material of PET film as used in Example X1 was provided. A heat resistant slip layer as described in Example X1 was previously formed on the other side of the base material. A liquid composition B for an adhesive layer having the following composition was gravure coated onto the base material on its side remote from the heat resistant slip layer at a coverage of 0.06 g/m$^2$ on a dry basis, and the coating was dried to form an adhesive layer. A dye layer was formed on the adhesive layer in the same manner as in Example X1. Thus, a thermal transfer sheet of Example X2 was prepared.

| <Liquid composition B for adhesive layer> | |
|---|---|
| Polyvinylpyrrolidone resin (K-90, manufactured by ISP K.K.) | 7.5 parts |
| Three-dimensionally crosslinked product of polyvinylpyrrolidone resin having degree of crosslinking of about 40% (Vivi Print 540 polymer, manufactured by ISP K.K.) | 2.5 parts |
| Methyl ethyl ketone | 83 parts |
| Isopropyl alcohol | 83 parts |

Example X3

The same base material of PET film as used in Example X1 was provided. A heat resistant slip layer as described in Example X1 was previously formed on the other side of the base material. A liquid composition C for an adhesive layer having the following composition was gravure coated onto the base material on its side remote from the heat resistant slip layer at a coverage of 0.03 g/m$^2$ on a dry basis, and the coating was dried to form an adhesive layer. A dye layer was formed on the adhesive layer in the same manner as in Example X1. Thus, a thermal transfer sheet of Example X3 was prepared.

| <Liquid composition C for adhesive layer> | |
|---|---|
| Polyvinylpyrrolidone resin (K-90, manufactured by ISP K.K.) | 7.5 parts |
| Three-dimensionally crosslinked product of polyvinylpyrrolidone resin having degree of crosslinking of about 40% (Vivi Print 540 polymer, manufactured by ISP K.K.) | 7.5 parts |
| Methyl ethyl ketone | 125 parts |
| Isopropyl alcohol | 125 parts |

Example X4

The same base material of PET film as used in Example X1 was provided. A heat resistant slip layer as described in Example X1 was previously formed on the other side of the base material. A liquid composition C for an adhesive layer as used in Example X3 was gravure coated onto the base material on its side remote from the heat resistant slip layer at a coverage of 0.06 g/m$^2$ on a dry basis, and the coating was dried to form an adhesive layer. A dye layer was formed on the adhesive layer in the same manner as in Example X1 . Thus, a thermal transfer sheet of Example X4 was prepared.

Example X5

The same base material of PET film as used in Example X1 was provided. A heat resistant slip layer as described in Example X1 was previously formed on the other side of the base material. A liquid composition C for an adhesive layer as used in Example X3 was gravure coated onto the base material on its side remote from the heat resistant slip layer at a coverage of 0.2 g/m$^2$ on a dry basis, and the coating was dried to form an adhesive layer. A dye layer was formed on the adhesive layer in the same manner as in Example X1. Thus, a thermal transfer sheet of Example X5 was prepared.

Example X6

The same base material of PET film as used in Example X1 was provided. A heat resistant slip layer as described in Example X1 was previously formed on the other side of the base material. A liquid composition D for an adhesive layer having the following composition was gravure coated onto the base material on its side remote from the heat resistant slip layer at a coverage of 0.06 g/m$^2$ on a dry basis, and the coating was dried to form an adhesive layer. A dye layer was formed on the adhesive layer in the same manner as in Example X1. Thus, a thermal transfer sheet of Example X6 was prepared.

| <Liquid composition D for adhesive layer> | |
|---|---|
| Polyvinylpyrrolidone resin (K-90, manufactured by ISP K.K.) | 2.5 parts |
| Three-dimensionally crosslinked product of polyvinylpyrrolidone resin having degree of crosslinking of about 40% (Vivi Print 540 polymer, manufactured by ISP K.K.) | 7.5 parts |
| Methyl ethyl ketone | 83 parts |
| Isopropyl alcohol | 83 parts |

Example X7

The same base material of PET film as used in Example X1 was provided. A heat resistant slip layer as described in Example X1 was previously formed on the other side of the base material. A liquid composition E for an adhesive layer having the following composition was gravure coated onto the base material on its side remote from the heat resistant slip layer at a coverage of 0.06 g/m$^2$ on a dry basis, and the coating was dried to form an adhesive layer. A dye layer was formed on the adhesive layer in the same manner as in Example X1. Thus, a thermal transfer sheet of Example X7 was prepared.

| <Liquid composition E for adhesive layer> | |
|---|---|
| Three-dimensionally crosslinked product of polyvinylpyrrolidone resin having degree of crosslinking of about 40% (Vivi Print 540 polymer, manufactured by ISP K.K.) | 10 parts |
| Methyl ethyl ketone | 83 parts |
| Isopropyl alcohol | 83 parts |

Unlike other Examples, in the liquid composition E for an adhesive layer, the polyvinylpyrrolidone resin of tradename K-90 was not contained. The material of tradename ViviPrint540 polymer used instead of K-90 was a polyvinylpyrrolidone resin in which about 40% of one molecule of the polyvinylpyrrolidone resin has been crosslinked with the remaining about 60% being a linear polymer.

Comparative Example X1

The same base material of PET film as used in Example X1 was provided. A heat resistant slip layer as described in Example X1 was previously formed on the other side of the base material. A liquid composition F for an adhesive layer having the following composition was gravure coated onto the base material on its side remote from the heat resistant slip layer at a coverage of 0.06 g/m$^2$ on a dry basis, and the coating was dried to form an adhesive layer. A dye layer was formed on the adhesive layer in the same manner as in Example X1. Thus, a thermal transfer sheet of Comparative Example X1 was prepared.

| <Liquid composition F for adhesive layer> | |
|---|---|
| Polyvinylpyrrolidone resin (K-90, manufactured by ISP K.K.) | 10 parts |
| Methyl ethyl ketone | 83 parts |
| Isopropyl alcohol | 83 parts |

Comparative Example X2

The same base material of PET film as used in Example X1 was provided. A heat resistant slip layer as described in Example X1 was previously formed on the other side of the base material. A liquid composition G for an adhesive layer having the following composition was gravure coated onto the base material on its side remote from the heat resistant slip layer at a coverage of 0.06 g/m$^2$ on a dry basis, and the coating was dried to form an adhesive layer. A dye layer was formed on the adhesive layer in the same manner as in Example X1. Thus, a thermal transfer sheet of Comparative Example X2 was prepared.

| <Liquid composition G for adhesive layer> | |
|---|---|
| Polyvinylpyrrolidone resin (K-90, manufactured by ISP K.K.) | 9.5 parts |
| Three-dimensionally crosslinked product of polyvinylpyrrolidone resin having degree of crosslinking of about 40% (Vivi Print 540 polymer, manufactured by ISP K.K.) | 0.5 part |

-continued

| <Liquid composition G for adhesive layer> | |
|---|---|
| Methyl ethyl ketone | 83 parts |
| Isopropyl alcohol | 83 parts |

Comparative Example X3

The same base material of PET film as used in Example X1 was provided. A heat resistant slip layer as described in Example X1 was previously formed on the other side of the base material. A liquid composition C for an adhesive layer as used in Example X3 was gravure coated onto the base material on its side remote from the heat resistant slip layer at a coverage of 0.35 g/m$^2$ on a dry basis, and the coating was dried to form an adhesive layer. A dye layer was formed on the adhesive layer in the same manner as in Example X1. Thus, a thermal transfer sheet of Comparative Example X3 was prepared.

Evaluation Test X

The thermal transfer sheets of each Example X and Comparative Example X were evaluated for heat-resistant adhesion at room temperature and under high-temperature and high-humidity conditions and adhesion to an image-receiving sheet by the following methods.

(Evaluation 1: Heat Resistant Adhesion)

Each of the thermal transfer sheets of Example X and Comparative Example X as a sample was applied onto a mount so that the dye layer surface faced upward, that is, the mount was brought into contact with the heat resistant slip layer. A reference ribbon 1 (an assembly comprising a dye layer, which is the same as that in the sample, provided directly on an easy-adhesion treated PET film of DIAFOIL K230E manufactured by MITSUBISHI POLYESTER FILM CORPORATION as a base material) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 2.5 kg/cm$^2$, and pressing time 2 sec, followed by separation. The assembly was then visually inspected for residual dye layer (undesired transfer of dye layer) in each of the sample and the reference ribbon 1. The results were evaluated according to the following criteria. In this case, the heat resistant adhesion test was carried out by the following two testing methods. In one of the testing methods, the heat sealing was carried out in such a state that both the thermal transfer sheets of Example X and Comparative Example X as samples and the reference ribbon 1 were allowed to stand at room temperature. In the other testing method, the heat sealing was carried out after both the sample thermal transfer sheets and the reference ribbon 1 were allowed to stand under an environment of 40° C. and 90% RH for 16 hr.

Evaluation Criteria

○: The area of the dye layer remaining on the sample side is larger than the area of the dye layer remaining on the reference ribbon side.

Δ: The area of the dye layer remaining on the sample side is equal to the area of the dye layer remaining on the reference ribbon side.

x : The area of the dye layer remaining on the sample side is smaller than the area of the dye layer remaining on the reference ribbon side.

(Evaluation 2: Heat Resistant Adhesion)

Each of the thermal transfer sheets of Example X and Comparative Example X as a sample was applied onto a mount so that the dye layer surface faced upward, that is, the mount was brought into contact with the heat resistant slip layer. A reference ribbon 2 (an assembly comprising a dye layer, which is the same as that in the sample, provided on a surface of a base material formed of a PET film of DIAFOIL K880 manufactured by MITSUBISHI POLYESTER FILM CORPORATION through an adhesive layer formed of a polyvinylpyrrolidone resin (K-90, manufactured by ISP K.K.) provided at a coverage of 0.06 g/m$^2$ on a dry basis (which is the same as the adhesive layer as described in Comparative Example X1)) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 2.5 kg/cm$^2$, and pressing time 2 sec, followed by separation. The assembly was then visually inspected for residual dye layer (undesired transfer of dye layer) in each of the sample and the reference ribbon 2. The results were evaluated according to the criteria as described in heat resistant adhesion 1. In this case, the heat resistant adhesion test was carried out by the following two testing methods. In one of the testing methods, the heat sealing was carried out in such a state that both the thermal transfer sheets of Example X and Comparative Example X as samples and the reference ribbon 2 were allowed to stand at room temperature. In the other testing method, the heat sealing was carried out after both the sample thermal transfer sheets and the reference ribbon 2 were allowed to stand under an environment of 40° C. and 90%RH for 16 hr.

(Evaluation 3: Adhesion to Image Receiving Sheet)

Each of the thermal transfer sheets of Example X and Comparative Example X and a specialty standard set of an image receiving sheet for a digital color printer P-200, manufactured by Olympus Optical Co., LTD. were put on top of each other so that the dye layer surface in the thermal transfer sheet was brought into contact with the image receiving surface in the image receiving sheet. The assembly was heat sealed under conditions of temperature 100 to 130° C., pressure 2.5 kg/cm$^2$, and pressing time 2 sec. Thereafter, both the sheets were separated from each other and were visually inspected for the state of separation between the dye layer in the sample and the image receiving layer in the image receiving sheet, and the results were evaluated according to the following criteria. In this case, the heat sealing of the thermal transfer sheet and the image receiving sheet was carried out in such a state that these sheets were allowed to stand at room temperature.

Evaluation Criteria

○: No abnormal transfer of image receiving layer onto dye layer side took place.

x: Abnormal transfer of image receiving layer onto dye layer side took place.

The results of evaluation of each item for Example X and Comparative Example X are shown in Table 2 below.

TABLE 2

| | Addition amount of VIVI PRINT 540P*1 | Content of three-dimensionally crosslinked PVP*2 | cover-age g/m$^2$ | Heat resistant adhesion 1 | | Heat resistant adhesion 2 | | Adhesion to image receiving sheet |
|---|---|---|---|---|---|---|---|---|
| | | | | Room temp. | High temp. and high humidity | Room temp. | High temp. and high humidity | |
| Ex. X1 | 10% | 4% | 0.06 | ○ | ○ | Δ | ○ | ○ |
| Ex. X2 | 25% | 10% | 0.06 | ○ | ○ | ○ | ○ | ○ |
| Ex. X3 | 50% | 20% | 0.03 | ○ | ○ | ○ | ○ | ○ |
| Ex. X4 | 50% | 20% | 0.05 | ○ | ○ | ○ | ○ | ○ |
| Ex. X5 | 50% | 20% | 0.2 | ○ | ○ | ○ | ○ | ○ |
| Ex. X6 | 75% | 30% | 0.06 | ○ | ○ | ○ | ○ | ○ |
| Ex. X7 | 100% | 40% | 0.06 | ○ | ○ | Δ | ○ | ○ |
| Comp. Ex. X1 | 0% | 0% | 0.06 | ○ | x | — | — | ○ |
| Comp. Ex. X2 | 5% | 2% | 0.06 | ○ | x | Δ | ○ | ○ |
| Comp. Ex. X3 | 50% | 20% | 0.35 | ○ | ○ | ○ | ○ | x |

*1The addition amount of ViviPrint 540 polymer is the percentage of addition amount based on the total amount of the ViviPrint 540 polymer and the polyvinylpyrrolidone resin (K-90, manufactured by ISP K.K.).
*2Content of three-dimensionally crosslinked polyvinylpyrrolidone resin based on the total solid content of the adhesive layer.

As is apparent from the above results, for Examples X2 to X6 wherein the content of the three-dimensionally crosslinked polyvinylpyrrolidone resin in the adhesive layer, that is, the amount of the partially crosslinked polyvinylpyrrolidone resin, which is a crosslinked part of the polyvinylpyrrolidone, per molecule was 10% to 30% based on the whole solid content of the adhesive layer, good results could be obtained for all evaluation items, that is, the heat resistant adhesions 1 and 2 and the adhesion to an image receiving sheet. For Example 1 wherein the content of the three-dimensionally crosslinked part of the polyvinylpyrrolidone resin in the adhesive layer was 4% based on the total solid content of the adhesive layer, the heat resistant adhesion 2 as determined at room temperature was equivalent to that of the reference ribbon, but on the other hand, under high temperature and high humidity conditions, the adhesion between the base material and the dye layer was higher than that in the reference ribbon. Further, also for Example X7 wherein the content of the three-dimensionally crosslinked part of the polyvinylpyrrolidone resin in the adhesive layer was 40% based on the total solid content of the adhesive layer, the heat resistant adhesion 2 as determined at room temperature was equivalent to that in the reference ribbon, but on the other hand, under high temperature and high humidity conditions, the adhesion between the base material and the dye layer was higher than that in the reference ribbon.

For Comparative Example X1 wherein the three-dimensionally crosslinked polyvinylpyrrolidone resin was not contained in the adhesive layer, it was found that the heat resistant adhesion 1 between the dye layer and the base material as determined under high temperature and high humidity conditions was lowered. For Comparative Example X2 wherein the content of the three-dimensionally crosslinked part of the polyvinylpyrrolidone resin in the adhesive layer was 2% based on the total solid content of the adhesive layer, it was found that the adhesion between the dye layer and the base material as determined under high temperature and high humidity conditions was lowered. Further, for Comparative Example X3 wherein the content of the three-dimensionally crosslinked part of the polyvinylpyrrolidone resin in the adhesive layer was 20% based on the total solid content of the adhesive layer, the receptive layer was likely to be abnormally transferred to the dye layer side at the time of thermal transfer, probably because, due to large coverage (0.35 g/m$^2$ on a dry basis) of the adhesive layer, the adhesive layer and the dye layer are likely to be mixed together in the coating of the dye layer.

Second Aspect of Invention

Preparation of Thermal Transfer Sheet

Example Y1

A 6 μm-thick polyethylene terephthalate (PET) film (DIAFOIL K 203 E, manufactured by Mitsubishi Polyester Film Co., Ltd.) subjected to easy-adhesion treatment was provided as a base material. A liquid composition A having the following composition for an adhesive layer was gravure coated onto the easy-adhesion treated face in the PET film at a coverage of 0.2 g/m$^2$ on a dry basis, and the coating was dried to form an adhesive layer. A liquid composition (i) having the following composition for a dye layer was then gravure coated on the adhesive layer at a coverage of 0.8 g/m$^2$ on a dry basis, and the coating was dried to form a dye layer. Thus, a thermal transfer sheet of Example Y1 was prepared. In this case, a liquid composition a having the following composition for a heat-resistant slip layer was previously gravure coated on the other side of the base material at a coverage of 1.0 g/m$^2$ on a dry basis, and the coating was dried to form a heat resistant slip layer.

| <Liquid composition A for adhesive layer> | |
|---|---|
| Polyvinylpyrrolidone resin (K-90, manufactured by ISP K.K.) | 5 parts |
| Silanol group-containing resin (APZ-6633, manufactured by Nippon Unicar Co., Ltd.) | 0.4 part |
| Methyl ethyl ketone | 47.3 parts |
| Isopropyl alcohol | 47.3 parts |

| <Liquid composition (i) for dye layer> | |
|---|---|
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |

| <Liquid composition a for heat resistant slip layer> | |
|---|---|
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example Y2

The same easy-adhesion treated PET film base material as used in Example Y1 was provided. A heat-resistant slip layer as described in Example Y1 was previously formed on the other side of the base material. The liquid composition A for an adhesive layer as described above was gravure coated onto the easy-adhesion treated face in the base material at a coverage of 0.05 g/m$^2$ on a dry basis, and the coating was dried to form an adhesive layer. A dye layer was formed on the adhesive layer in the same manner as in Example Y1. Thus, a thermal transfer sheet of Example Y2 was prepared.

Example Y3

The same easy-adhesion treated PET film base material as used in Example Y1 was provided. A heat resistant slip layer as described in Example Y1 was previously formed on the other side of the base material. A liquid composition B for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y3 was prepared.

| <Liquid composition B for adhesive layer> | |
|---|---|
| Polyvinylpyrrolidone resin (K-90, manufactured by ISP K.K.) | 5 parts |
| Silanol group-containing resin (APZ-6633, manufactured by Nippon Unicar Co., Ltd.) | 0.8 part |
| Methyl ethyl ketone | 47.1 parts |
| Isopropyl alcohol | 47.1 parts |

Example Y4

The same easy-adhesion treated PET film base material as used in Example Y1 was provided. A heat resistant slip layer as described in Example Y1 was previously formed on the other side of the base material. A liquid composition C for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y4 was prepared.

| <Liquid composition C for adhesive layer> | |
|---|---|
| Polyvinylpyrrolidone resin (Luviskol K80, manufactured by BASF Japan Ltd.) | 5 parts |
| Silanol group-containing resin (APZ-6633, manufactured by Nippon Unicar Co., Ltd.) | 0.4 part |
| Methyl ethyl ketone | 47.3 parts |
| Isopropyl alcohol | 47.3 parts |

Example Y5

The same easy-adhesion treated PET film base material as used in Example Y1 was provided. A heat resistant slip layer as described in Example Y1 was previously formed on the other side of the base material. A liquid composition D for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y5 was prepared.

| <Liquid composition D for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Silanol group-containing resin (APZ-6633, manufactured by Nippon Unicar Co., Ltd.) | 0.4 part |
| Methyl ethyl ketone | 47.3 parts |
| Isopropyl alcohol | 47.3 parts |

Example Y6

The same easy-adhesion treated PET film base material as used in Example Y1 was provided. A heat resistant slip layer as described in Example Y1 was previously formed on the other side of the base material. A liquid composition E for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1.

Thus, a thermal transfer sheet of Example Y6 was prepared.

| <Liquid composition E for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |

-continued

| <Liquid composition E for adhesive layer> | |
|---|---|
| Silanol group-containing resin (APZ-6633, manufactured by Nippon Unicar Co., Ltd.) | 0.8 part |
| Methyl ethyl ketone | 47.1 parts |
| Isopropyl alcohol | 47.1 parts |

Example Y7

A 6 μm-thick polyethylene terephthalate (PET) film (DIAFOIL K 880, manufactured by Mitsubishi Polyester Film Co., Ltd.) as a base material was subjected to corona irradiation treatment. A liquid composition D for an adhesive layer as used in Example Y5 was gravure coated at a coverage of 0.2 g/m$^2$ on a dry basis onto the base material in its side subjected to corona irradiation treatment, and the coating was dried to form an adhesive layer. Further, a dye layer was formed on the adhesive layer in the same manner as in Example Y1. Thus, a thermal transfer sheet of Example Y7 was prepared. In this case, a heat-resistant slip layer was previously formed on the other side of the base material in the same manner as in Example Y1.

Example Y8

The same easy-adhesion treated PET film base material as used in Example Y1 was provided. A heat resistant slip layer as described in Example Y1 was previously formed on the other side of the base material. A liquid composition F for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y8 was prepared.

| <Liquid composition F for adhesive layer> | |
|---|---|
| Polyvinylpyrrolidone resin (K-90, manufactured by ISP K.K.) | 3 parts |
| Vinylpyrrolidone-vinyl acetate copolymer resin (I-335, manufactured by ISP K.K.) | 2 parts |
| Silanol group-containing resin (APZ-6633, manufactured by Nippon Unicar Co., Ltd.) | 0.4 part |
| Methyl ethyl ketone | 47.3 parts |
| Isopropyl alcohol | 47.3 parts |

Example Y9

The same easy-adhesion treated PET film base material as used in Example Y1 was provided. A heat resistant slip layer as described in Example Y1 was previously formed on the other side of the base material. A liquid composition G for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y9 was prepared.

| <Liquid composition G for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Silanol group-containing resin (APZ-6633, manufactured by Nippon Unicar Co., Ltd.) | 0.4 part |
| Polyester resin (Vylon 200, manufactured by Toyobo Co., Ltd.) | 0.4 part |
| Methyl ethyl ketone | 46.3 parts |
| Isopropyl alcohol | 46.3 parts |
| Toluene | 1.6 parts |

Example Y10

The same easy-adhesion treated PET film base material as used in Example Y1 was provided. A heat resistant slip layer as described in Example Y1 was previously formed on the other side of the base material. A liquid composition H for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y10 was prepared.

| <Liquid composition H for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Silane coupling agent (A-187, manufactured by Nippon Unicar Co., Ltd.) | 0.4 part |
| Methyl ethyl ketone | 47.3 parts |
| Isopropyl alcohol | 47.3 parts |

Example Y11

The same easy-adhesion treated PET film base material as used in Example Y1 was provided. A heat resistant slip layer as described in Example Y1 was previously formed on the other side of the base material. A liquid composition I for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y11 was prepared.

| <Liquid composition I for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Silane coupling agent (A-1100, manufactured by Nippon Unicar Co., Ltd.) | 0.4 part |
| Methyl ethyl ketone | 47.3 parts |
| Isopropyl alcohol | 47.3 parts |

Example Y12

The same easy-adhesion treated PET film base material as used in Example Y1 was provided. A heat resistant slip layer as described in Example Y1 was previously formed on the other side of the base material. A liquid composition J for an adhesive layer having the following composition was gravure coated onto the easy-adhesion treated face in the base material at a coverage of 0.2 g/m2 on a dry basis, and the coating was dried to form an adhesive layer. A dye layer was formed on the adhesive layer in the same manner as in Example Y1. Thus, a thermal transfer sheet of Example Y12 was prepared.

| <Liquid composition J for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Silane coupling agent (A-174, manufactured by Nippon Unicar Co., Ltd.) | 0.4 part |
| Methyl ethyl ketone | 47.3 parts |
| Isopropyl alcohol | 47.3 parts |

Example Y13

The same easy-adhesion treated PET film base material as used in Example Y1 was provided. A heat resistant slip layer as described in Example Y1 was previously formed on the other side of the base material. A liquid composition K for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Example Y13 was prepared.

| <Liquid composition K for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Silane coupling agent (A-1100 manufactured by Nippon Unicar Co., Ltd.) | 0.4 part |
| Polyester resin (Vylon 200, manufactured by Toyobo Co., Ltd.) | 0.4 part |
| Methyl ethyl ketone | 46.3 parts |
| Isopropyl alcohol | 46.3 parts |
| Toluene | 1.6 parts |

Example Y14

A thermal transfer sheet of Example Y14 was prepared in the same manner as in Example Y1, except that the adhesive layer was formed by gravure coating the coating composition A for an adhesive layer at a coverage of 0.1 g/m$^2$ on a dry basis and drying the coating.

Comparative Example Y1

The same easy-adhesion treated PET film base material as used in Example Y1 was provided. A heat resistant slip layer as described in Example Y1 was previously formed on the other side of the base material. The dye layer as described in Example Y1 was formed directly on the easy-adhesion treated face of the base material without coating the liquid composition for an adhesive layer to prepare a thermal transfer sheet of Comparative Example Y2

Comparative Example Y2

The same easy-adhesion treated PET film base material as used in Example Y1 was provided. A heat resistant slip layer as described in Example Y1 was previously formed on the other side of the base material. A liquid composition L for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Comparative Example Y2 was prepared.

| <Liquid composition L for adhesive layer> | |
|---|---|
| Polyvinylpyrrolidone resin (K-90, manufactured by ISP K.K.) | 5 parts |
| Methyl ethyl ketone | 47.5 parts |
| Isopropyl alcohol | 47.5 parts |

Comparative Example Y3

The same easy-adhesion treated PET film base material as used in Example Y1 was provided. A heat resistant slip layer as described in Example Y1 was previously formed on the other side of the base material. A liquid composition M for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Comparative Example Y3 was prepared.

| <Liquid composition M for adhesive layer> | |
|---|---|
| Polyvinylpyrrolidone resin (Luviskol K80, manufactured by BASF Japan) | 5 parts |
| Methyl ethyl ketone | 47.5 parts |
| Isopropyl alcohol | 47.5 parts |

Comparative Example Y4

The same easy-adhesion treated PET film base material as used in Example Y1 was provided. A heat resistant slip layer as described in Example Y1 was previously formed on the other side of the base material. A liquid composition N for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Comparative Example Y4 was prepared.

| <Liquid composition N for adhesive layer> | |
|---|---|
| Polyvinylpyrrolidone resin (K-90, manufactured by ISP K.K.) | 5 parts |
| Polyester resin (Vylon 200, manufactured by Toyobo Co., Ltd.) | 0.4 part |
| Methyl ethyl ketone | 46.5 parts |
| Isopropyl alcohol | 46.5 parts |
| Toluene | 1.6 parts |

Comparative Example Y5

The same easy-adhesion treated PET film base material as used in Example Y1 was provided. A heat resistant slip layer as described in Example Y1 was previously formed on the other side of the base material. A liquid composition O for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Comparative Example Y5 was prepared.

| <Liquid composition O for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Methyl ethyl ketone | 47.5 parts |
| Isopropyl alcohol | 47.5 parts |

Comparative Example Y6

The corona treated PET film base material as described in Example Y7 was provided. A heat resistant slip layer as described in Example Y1 was previously formed on the other side of the base material. The liquid composition O for an adhesive layer as described in Comparative Example Y5 was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Comparative Example Y6 was prepared.

Comparative Example Y7

The same easy-adhesion treated PET film base material as used in Example Y1 was provided. A heat resistant slip layer as described in Example Y1 was previously formed on the other side of the base material. A liquid composition P for an adhesive layer having the following composition was gravure coated onto the easy-adhesion treated face in the base material at a coverage of 0.2 g/m$^2$ on a dry basis, and the coating was dried to form an adhesive layer. A dye layer was formed on the adhesive layer in the same manner as in Example Y1. Thus, a thermal transfer sheet of Comparative Example Y7 was prepared.

| <Liquid composition P for adhesive layer> | |
|---|---|
| Polyvinylpyrrolidone resin (K-90, manufactured by ISP K.K.) | 2.5 parts |
| Partially crosslinked product of polyvinylpyrrolidone (ViviPrint 540P, manufactured by ISP K.K.) | 2.5 parts |
| Polyester resin (Vylon 200, manufactured by Toyobo Co., Ltd.) | 0.4 part |
| Methyl ethyl ketone | 46.5 parts |
| Isopropyl alcohol | 46.5 parts |
| Toluene | 1.6 parts |

Evaluation Test Y

The thermal transfer sheets prepared in the above Examples Y and Comparative Examples Y were evaluated for transferred image density and suitability for printing by the following methods.

(Evaluation of Transferred Image Density)

Printing was carried out under the following conditions, and the maximum density of the print matter was measured.

The thermal transfer sheets prepared in Examples Y1 to Y13 and Comparative Examples Y1 to Y7 were used in combination with an image receiving sheet prepared using an ink composition having the following composition, and printing was carried out with Card Photo Printer CP-200 manufactured by Canon Inc. The maximum density (cyan) in the printed portion was measured with a Macbeth densitometer RD-918, manufactured by Sakata INX Corp. The thermal transfer sheet was patched to a cyan panel part in genuine media, and a cyan blotted image (gradation value 255/255: density max) print pattern was printed. The printing was carried out under an environment of temperature 30° C. and humidity 50%.

The image receiving sheet used was prepared as follows. A 200 μm-thick polyethylene terephthalate (PET) film (Lumirror, manufactured by Toray Industries, Inc.) was provided, and an ink composition A for image receiving layer formation having the following composition was coated on the base material by wire bar coating to a thickness of 5 μm on a dry basis to prepare an image receiving sheet.

| <Ink composition A for image receiving layer formation> | |
|---|---|
| Polyester resin (Vylon 200, manufactured by Toyobo Co., Ltd.) | 18 parts |
| OH-modified silicone (X-62-1421B manufactured by The Shin-Etsu Chemical Co., Ltd.) | 0.2 part |
| Polyether-modified silicone (FZ-2101 manufactured by Nippon Unicar Co., Ltd.) | 0.2 part |
| Xylene diisocyanate (Takenate A-14 manufactured by MITSUI TAKEDA CHEMICALS, INC.) | 0.1 part |
| Tin-based catalyst (STANN BL manufactured by Sankyo Organic Chemicals Co., Ltd.) | 0.02 part |
| Methyl ethyl ketone | 40.74 parts |
| Toluene | 40.74 parts |

<Evaluation Criteria for Transferred Image Density>

Relative to the maximum density of a ribbon (Comparative Example Y1), wherein an adhesive layer is not sandwiched between the dye layer and the base material, ◎: the maximum density was not less than 110%.

○: the maximum density was not less than 105% and less than 110%

(Suitability for Printing)

Printing was carried out under the following conditions for evaluation of suitability for printing.

The thermal transfer sheet and the image receiving sheet as used in the evaluation of transferred image density were provided. The thermal transfer sheet was patched to yellow, magenta, and cyan panel parts in genuine media, and a black blotted image (gradation value 255/255: density max) print pattern was printed. After storage of the thermal transfer sheet and the image receiving sheet under an environment of temperature 40° C. and humidity 90% for two weeks, the printing was carried out under two environments, that is, under an environment of temperature 30° C. and humidity 50% and under an environment of temperature 40° C. and humidity 90%.

<Evaluation Criteria for Suitability for Printing>

○: Defective printing phenomena such as abnormal transfer, uneven transfer, and omission of transfer did not occur for all the thermal transfer sheets patched respectively to the yellow, magenta, and cyan panel parts.

Δ○: Defective printing phenomena such as abnormal transfer, uneven transfer, and omission of transfer occurred for one of the three patched thermal transfer sheets (for the thermal transfer sheet patched to the cyan panel part).

Δ: Defective printing phenomena such as abnormal transfer, uneven transfer, and omission of transfer occurred for two of the three patched thermal transfer sheets (for the thermal transfer sheets patched respectively to the magenta panel part and the cyan panel part).

x: Defective printing phenomena such as abnormal transfer, uneven transfer, and omission of transfer occurred for all the three patched thermal transfer sheets.

The results of evaluation on each item for Example Y and Comparative Example Y are shown in Table 3 below.

TABLE 3

| | Suitability for printing | | Transferred |
|---|---|---|---|
| | 30° C./50% | 40° C./90% | image density |
| Example Y | | | |
| 1 | ○ | ○ | ◎ |
| 2 | ○ | ○ | ◎ |
| 3 | ○ | ○ | ○ |
| 4 | ○ | ○ | ◎ |
| 5 | ○ | ○ | ◎ |
| 6 | ○ | ○ | ○ |
| 7 | ○ | ○ | ◎ |
| 8 | ○ | ○ | ○ |
| 9 | ○ | ○ | ○ |
| 10 | ○ | ○ | ◎ |
| 11 | ○ | ○ | ◎ |
| 12 | ○ | ○ | ◎ |
| 13 | ○ | ○ | ○ |
| 14 | ○ | ○ | ◎ |
| Comparative Example Y | | | |
| 1 | ○ | ○ | — |
| 2 | ○ | X | ◎ |
| 3 | ○ | X | ◎ |
| 4 | ○ | X | ○ |
| 5 | ○ | Δ | ◎ |
| 6 | ○ | Δ | ◎ |
| 7 | ○ | Δ○ | ○ |

The above results show that, for Examples wherein the adhesive layer contains a polyvinylpyrrolidone resin and a silane or a silanol material, or contains a modification product of a polvinylpyrrolidone resin and a silane or a silanol material, as compared with Comparative Examples wherein a polyvinylpyrrolidone resin or a combination of a polyvinylpyrrolidone resin with a modification product of a polyvinylpyrrolidone resin is used, better suitability for printing under high humidity could be realized while maintaining high transferred image density in the printed matter. Thus, the thermal transfer sheet according to the present invention has good suitability for printing under high humidity conditions while maintaining high thermally transferred image density.

The invention claimed is:

1. A thermal transfer sheet comprising: a base material; a heat resistant slip layer; an adhesive layer; and a dye layer, wherein said heat resistant slip layer is provided on one side of said base material, said adhesive layer and said dye layer are provided in that order on the other side of said base material, and said adhesive layer comprises a three-dimensionally crosslinked product of a polyvinylpyrrolidone resin.

2. The thermal transfer sheet according to claim 1, wherein the proportion of three dimensional crosslinking in the polyvinylpyrrolidone resin is 5 to 50%.

3. The thermal transfer sheet according to claim 1, wherein the coverage of the components constituting the adhesive layer is 0.01 to 0.3 g/m$^2$ on a dry basis of the adhesive layer.

4. A thermal transfer sheet comprising: a base material; a heat resistant slip layer; an adhesive layer; and a dye layer, wherein said heat resistant slip layer is provided on one side of said base material, said adhesive layer and said dye layer are provided in that order on the other side of said base material, and said adhesive layer comprises a polyvinylpyrrolidone resin, and one material or a mixture of two or more materials selected from silanol group-containing resins, silanol group-containing oligomers, and silane coupling agents.

5. The thermal transfer sheet according to claim 4, wherein said adhesive layer further comprises a modification product of a polyvinylpyrrolidone resin.

6. The thermal transfer sheet according to claim 4, wherein the content of said one material or a mixture of two or more materials selected from silanol group-containing resins, silanol group-containing oligomers, and silane coupling agents is 1% by weight to 30% by weight based on the total solid content of the components constituting the adhesive layer.

7. The thermal transfer sheet according to claim 4, wherein the coverage of the components constituting the adhesive layer is 0.01 to 0.3 g/m$^2$ on a dry basis of the adhesive layer.

* * * * *